US008469341B2

(12) United States Patent
Ristau et al.

(10) Patent No.: US 8,469,341 B2
(45) Date of Patent: Jun. 25, 2013

(54) DESUPERHEATER SEAT-RING APPARATUS

(75) Inventors: David Ristau, Erie, PA (US); Veaceslav Ignatan, Erie, PA (US)

(73) Assignee: SPX Corporation, Charlotte, NC (US)

( * ) Notice: Subject to any disclaimer, the term of this patent is extended or adjusted under 35 U.S.C. 154(b) by 400 days.

(21) Appl. No.: 12/793,428

(22) Filed: Jun. 3, 2010

(65) Prior Publication Data

US 2011/0298141 A1 Dec. 8, 2011

(51) Int. Cl.
*B01F 3/04* (2006.01)

(52) U.S. Cl.
USPC ..... 261/62; 261/69.1; 261/DIG. 13

(58) Field of Classification Search
USPC ..... 261/62, 64.3, 69.1, 78.2, DIG. 13
See application file for complete search history.

(56) References Cited

U.S. PATENT DOCUMENTS 2,945,685 A * 7/1960 Bowlus ..... 261/62
3,609,066 A 9/1971 Wegmann
3,904,722 A 9/1975 Onoda et al.
3,981,946 A * 9/1976 Soya et al. ..... 261/64.3
4,011,287 A * 3/1977 Marley ..... 261/64.3
4,071,586 A 1/1978 Seger
4,278,619 A * 7/1981 Tiefenthaler ..... 261/62
5,692,684 A * 12/1997 Zurmuhlen ..... 239/563

OTHER PUBLICATIONS

International Search Report for International Application No. PCT/US2011/039012 dated Oct. 4, 2011.
SA-35 Steam Atomizing Desuperheater; DeZurik/Copes-Vulcan; Bulletin 1164; May 2001.
Samn-U Spring Assisted Multiple Nozzle Desuperheater; Dezurik/Copes-Vulcan; Bulletin 1165; Oct. 2001.
VO-II and VO-76 Variable Orifice Desuperheater; Dezurik/Copes-Vulcan; Bulletin 1147; Oct. 2001.
MNSD-V Multiple Nozzle Spray Desuperheater; Dezurik/Copes-Vulcan; Bulletin 1144; Sep. 2001.

* cited by examiner

*Primary Examiner* — Charles Bushey
(74) *Attorney, Agent, or Firm* — Baker & Hostetler LLP

(57) ABSTRACT

The present invention relates to an apparatus and method of deploying a desuperheater with a Seat-Ring designed to provide coolant injection at high temperature differential. The present invention's robust design provides for a high level of flexibility that allows operating at high temperature differentials between the coolant and the superheated fluid. The desuperheater Seat-Ring is made as a split hollow ring with a perpendicular slit traversing the ring's circumference. The opened slit design provides a high level of flexibility, which allows the seat ring to sustain severe temperature extremes by reducing thermal stress. The coolant is supplied to the seat ring through a specially designed coolant nipple liner connected to the seat-ring.

11 Claims, 7 Drawing Sheets

SECTION C-C

SECTION D-D

SECTION A-A

DESUPERHEATER SEAT-RING APPARATUS

FIELD OF THE INVENTION

The present invention relates to an apparatus and method of deploying a desuperheater with a Seat-Ring designed to provide coolant injection at high temperature differential. The present invention's robust design provides for a high level of flexibility that allows operating at high temperature differentials between the coolant and the superheated fluid. The desuperheater Seat-Ring is made as a split hollow ring with a perpendicular slit traversing the ring's circumference. The opened slit design provides a high level of flexibility, which allows the seat ring to sustain severe temperature extremes by reducing thermal stress. The coolant is supplied to the seat ring through a specially designed coolant nipple liner connected to the seat-ring.

BACKGROUND OF THE INVENTION

In the operation of steam and boiler systems, it is often the case that steam which is available for use will be at a temperature much greater than is necessary or desired for a particular end use. In such cases, it is customary to utilize a desuperheater, by which a fluid, usually water is injected into the flowing stream of high temperature steam and subsequently mixed. Ideally, the injected fluid itself almost immediately turns to steam, serving to convert the incoming, high temperature steam to a somewhat larger volume of steam at a lower temperature, that is, the steam will have less superheat.

An earlier patent granted to Sanford S. Bowlus, U.S. Pat. No. 2,945,685, discloses an advantageous form of automatic desuperheater device, known as a variable orifice desuperheater. In the device of the Bowlus patent, incoming steam, traveling vertically upward through a desuperheater housing inlet, was arranged to lift against gravity a weighted valve element. The extent to which the valve element opened is automatically a function of the volume and velocity of the incoming steam.

Surrounding the weighted valve element is a small orifice communicating with a source of desuperheating water. When steam is flowing through the system the weighted valve element is lifted, resulting in a high velocity flow of the steam around the valve and an atomizing action of the steam on the surrounding water. The arrangement is such that, relatively independently of the volume of steam flow within reasonable limits, there will be an effective atomizing action of the steam upon the water. The amount of water injected into the desuperheater and combined with the incoming steam is controlled independently, as a function of steam temperature.

In basic principle, the variable orifice desuperheater of the Bowlus U.S. Pat. No. 2,945,685 is highly effective in operation. Thus, the present invention seeks to utilize the significant operative principles of the earlier Bowlus patent, while at the same time incorporating such principles into a substantially improved physical embodiment, which is more resistant to thermal fatigue than prior devices and at the same time less costly to produce and maintain. These advantages are achieved without sacrifice of performance and, indeed, with improvement in performance in certain respects.

For a more complete understanding of the above and other features and advantages of the invention, reference should be made to the following detailed description of a preferred embodiment and to the accompanying drawings.

SUMMARY OF THE INVENTION

Embodiments of the present invention advantageously provide for a variable orifice desuperheater device for in-line operation in conjunction with upstream and downstream piping, comprising A desuperheating device for in-line operation in conjunction with superheated fluid piping upstream and downstream therefrom and of type comprising an upper housing section and a lower housing section joined with a middle housing chamber of enlarged diameter relative to the upstream and downstream piping to form a mixing chamber of enlarged diameter relative to the upstream and downstream piping, wherein said joined housing sections being adapted for connection to said upstream and downstream piping. It also includes a desuperheater seat ring support fixed in said middle housing and supporting therewith an annular seat injection ring with a slot and said annular seat injection ring being adapted for connection to a cooling fluid inlet piping to supply a cooling fluid to said annular seat injection ring and an axially disposed valve cage base structure mounted on said desuperheater seat ring support and a valve plug slideably received in the axially disposed valve cage base structure to cooperate with said slot of said annular seat injection.

Another embodiment is for a method for cooling a superheated fluid with a desuperheater device, which comprises receiving at a lower section of a desuperheater device, said superheated fluid and flowing said superheated fluid though a variable orifice in a middle section of said desuperheater device and flowing a cooling liquid into said middle section. The method also include mixing said superheated fluid and said cooling liquid in said middle section to produce a less superheated fluid and flowing said less superheated fluid out of said desuperheater device through an upper section.

An alternative embodiment is for the means for cooling a superheated fluid with a desuperheater device, including the means for receiving at a lower section of said desuperheater device said superheated fluid and the means for flowing said superheated fluid though a variable orifice in a middle section of said desuperheater device and the means for flowing a cooling liquid into said middle section. It further includes the means for mixing said superheated fluid and said cooling liquid in said middle section to produce a less superheated fluid and the means for flowing said less superheated fluid out of said desuperheater device through an upper section There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The above-mentioned and other features and advantages of this disclosure, and the manner of attaining them, will become more apparent and the disclosure itself will be better understood by reference to the following description of various embodiments of the disclosure taken in conjunction with the accompanying figures.

DETAILED DESCRIPTION OF THE INVENTION

Figure 1:
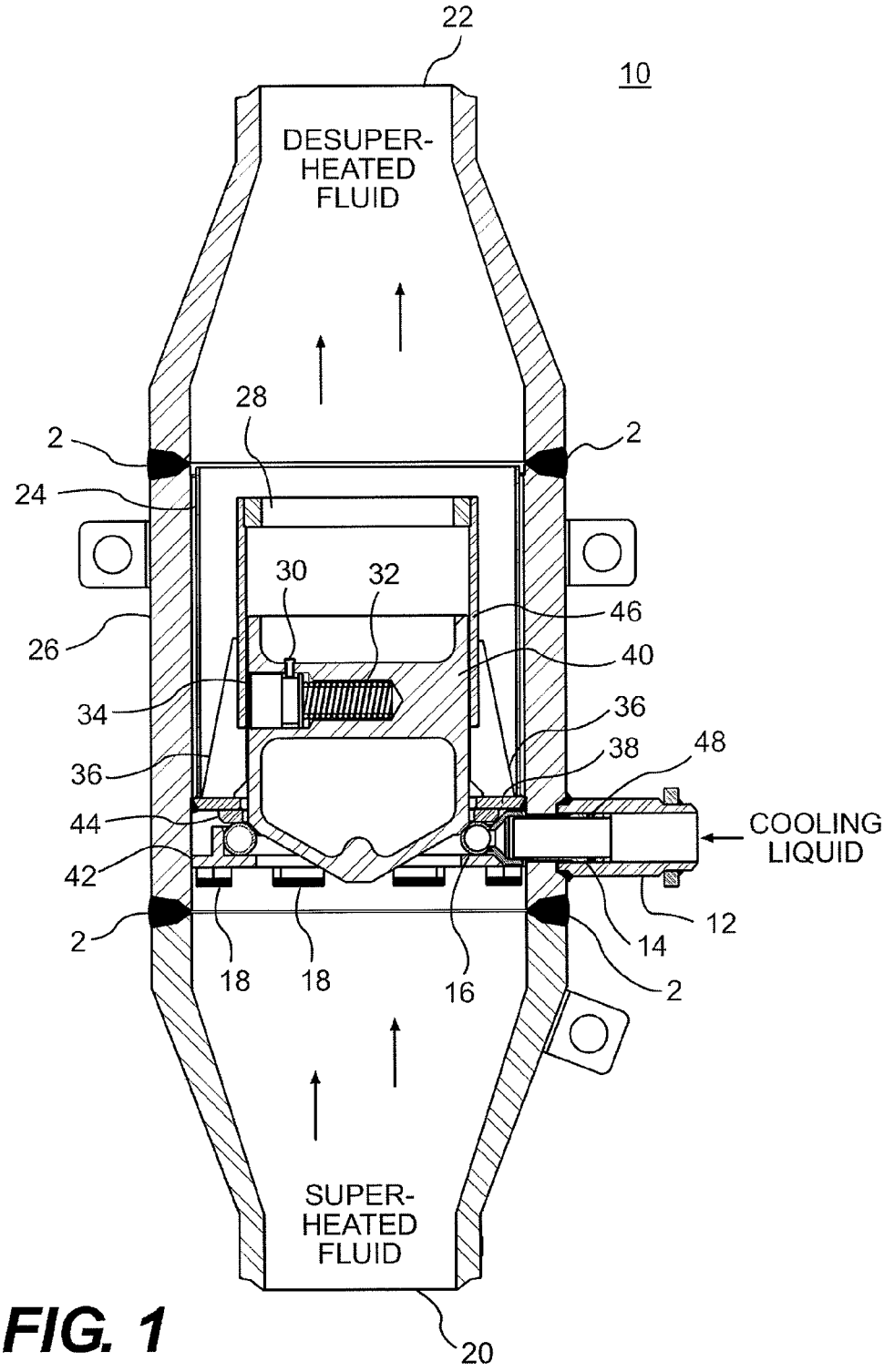
FIG. 1 is a cross sectional view of the desupheater valve of an embodiment of the present invention.

In the following detailed description, reference is made to the accompanying drawings, which form a part hereof and show by way of illustration specific embodiments in which the invention may be practiced. These embodiments are described in sufficient detail to enable those skilled in the art to practice them, and it is to be understood that other embodiments may be utilized, and that structural, logical and processing changes may be made. It should be appreciated that any list of materials or arrangements of elements is for example purposes only and is by no means intended to be exhaustive. The progression of processing steps described is an example; however, the sequence of steps is not limited to that set forth herein and may be changed as is known in the art, with the exception of steps necessarily occurring in a certain order.

The Desuperheater consists of a body which houses the desuperheater internals. The body incorporates a seat over which a cage is located in such a manner that a coolant annulus is created around the seat. The coolant enters this annulus by means of a branch on the desuperheater body. The plug is free floating, but incorporates a spring-loaded stability button which provides stability to the plug under light load conditions. Incorporated in the top of the cage is a plug stop to limit the amount of travel of the plug.

In service, incoming vapor acts on the underside of the plug, which is weighted in such a manner that a certain amount of the energy in the vapor is used to lift the plug. As more vapor flows through the desuperheater, the higher the plug is lifted, thus creating a variable orifice for the vapor flow. The energy used in lifting the plug creates a pressure drop across the seat which is quite constant regardless of the vapor flow. This pressure drop creates a relatively high velocity across the seat area, and it is at this point of low pressure constant velocity that the coolant is admitted into the vapor flow.

Coolant enters the annulus under the dictates of a control valve responsive to a temperature controller sensing the downstream vapor temperature. The coolant is admitted into the vapor flow through a peripheral gap between the underside of the cage and the top of the seat. Coolant is admitted via slot located around the circumference of the seat to ensure that unequal cooling does not occur.

The coolant is picked up by the vapor flow as it discharges from the seat, and the low pressure zone that exists at this point is instrumental in atomizing the coolant into fine particles. In the turbulence which ensues as a result of the change in direction and velocity of the vapor, intimate mixing of the vapor and coolant takes place. Above the plug, as the vapor attempts to return to laminar flow, a vortex is created and any particles of coolant not completely absorbed by the vapor are drawn into this vortex where they suffer a further pressure reduction which again speeds up the atomizing process.

As virtually all of the desuperheating occurs within the desuperheater body itself, and as no coolant impinges on either the desuperheater or associated piping, no protective thermal liners for downstream piping are required.

Figure 1A:
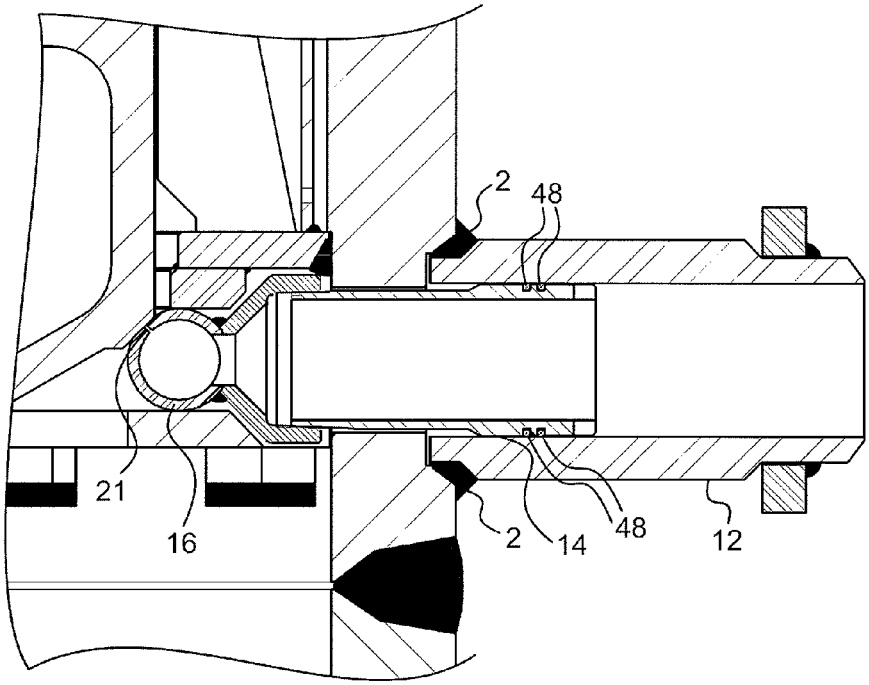
FIG. 1*a* is a close up cross sectional view of the desupheater valve of an embodiment of the present invention.
Figure 2:
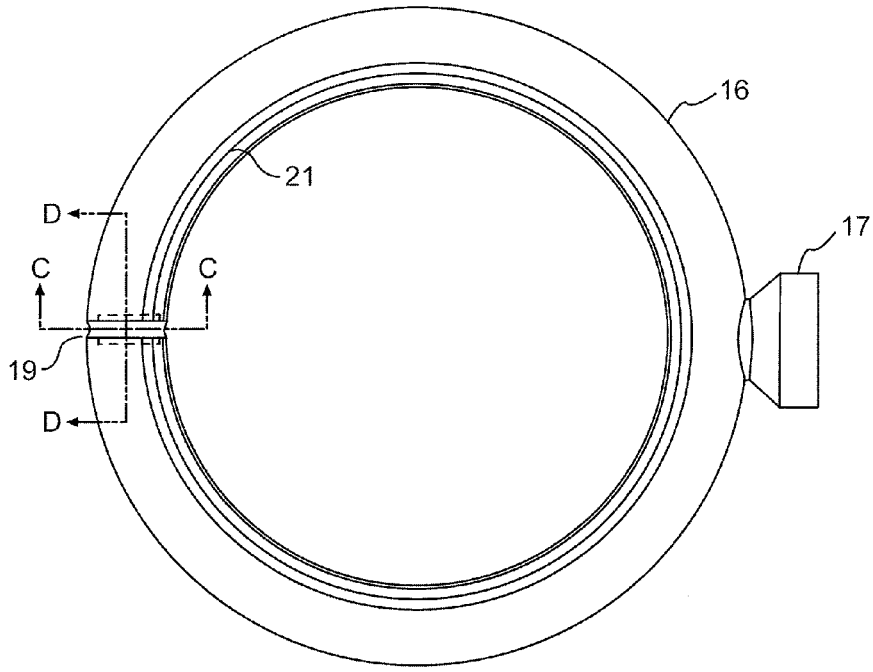
FIG. 2 is a plan view of the seat ring deployed in an embodiment of the present invention.
Figure 3:
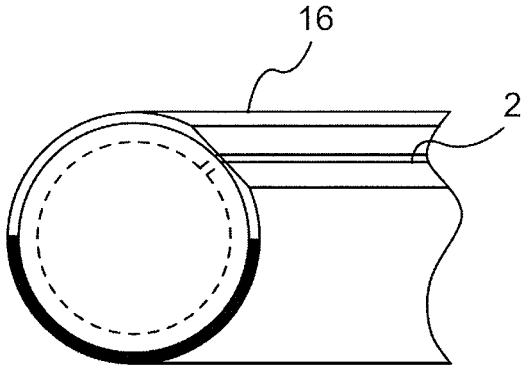
FIG. 3 is a sectional slice view of the seat ring.
Figure 4:
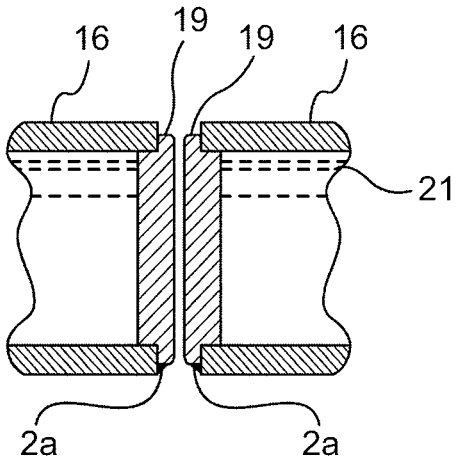
FIG. 4 is a view of the seat ring ends of the seat ring.

FIGS. 1 and 1*a* are a cross sectional views of an embodiment of the present invention. The desuperheater valve assembly 10 has three sections, a desuperheated fluid outlet or upper housing section 22, a middle housing section 26 and a superheated fluid inlet or lower housing section 20. They are joined together by welds 2. Although the welds are shown as a single welded butt joint, the joining of the upper housing section 22, the middle housing section 26 and the lower housing section 20 can be accomplished by any coupling method or casting method.

Inside the housing 26, the segment rings 18 can be found adjacent to the seat support ring 42. The seat support ring 42 holds and supports the annular seat injection ring 16. A spacer ring 44 is located above the seat injection ring 16. The valve cage base structure 38 is axially disposed inside the valve assembly and is on the downstream side of the spacer ring 44. In this embodiment, the cage base structure 38 is welded to the housing 26. A thermal liner 24 is attached to the cage base structure 38 and is positioned between the housing 26 and the internal cage 46. Cage ribs 36 are located positioned above the cage base 38. The plug stop 28 is located at the top of the internal cage 46 to limit travel of the plug assembly 40. The plug assembly 40 includes a locking pin 30, a loading spring 32 and a stability button 34 to provide stability to the plug under light load conditions. The thermal liner 24 is attached to the cage base structure 38 and is free to expand and contract reliving thermal stresses and protecting the housing 26 from thermal stress cracking. It may be attached, for example, by a welding process.

In operation, the cooling fluid enters the desuperheater valve through the cooling manifold fluid inlet 12 and flows through a first end of the coolant thermal sleeve 14. The coolant thermal sleeve protects the weld joints and also reduces thermal stresses, extending design live of the unit. The coolant thermal sleeve 14 has piston rings 48 positioned about the coolant thermal sleeve 14 to permit movement of the thermal sleeve 14 within the cooling manifold 12. The other end of the thermal sleeve 14 is positioned inside the annular seat injection ring 16.

Now, referring to FIGS. 1-4, the seat injection ring 16 is hollow and is shaped like a torus and includes a coolant nipple 17 attached to receive a cooling fluid. For example, the cooling fluid could be water, which is injected into the superheated fluid flowing through the desuperheater valve assembly 10. As discussed above, the superheated fluid is moving through the desuperheater device, the plug assembly 40 will move away from the seat injection ring 16 creating an atomizing orifice area and the cooling fluid is then dispersed into the superheated fluid via slot 21. The slot 21 travels around the circumference of the annular seat injection ring 16. The cooling fluid is pulled into the superheated vapor flow and the low pressure zone that exists at this point is aids in atomizing the cooling fluid into fine particles.

In this embodiment, the seat injection ring 16 is interrupted by two seat ring ends 19 and are attached by welds 2*a*. The interruption permits the seat injection ring 16 to expand and contract without causing damage to the device. For example, when the ring becomes heated and expands, the gap between the two seat ring ends 19 will narrow. However, depending on the temperatures involved in the operation of the desuperheater valve and the materials making up the desuperheater valve itself, other configurations of the seat injection ring 16 can be deployed. For example, the seat ring could be continuous, without the interruption and would not need the seat ring ends 19. The seat injection ring 16 many also employ only one seat ring end 19 to distribute the cooling liquid in a particular manner.

Figure 5:
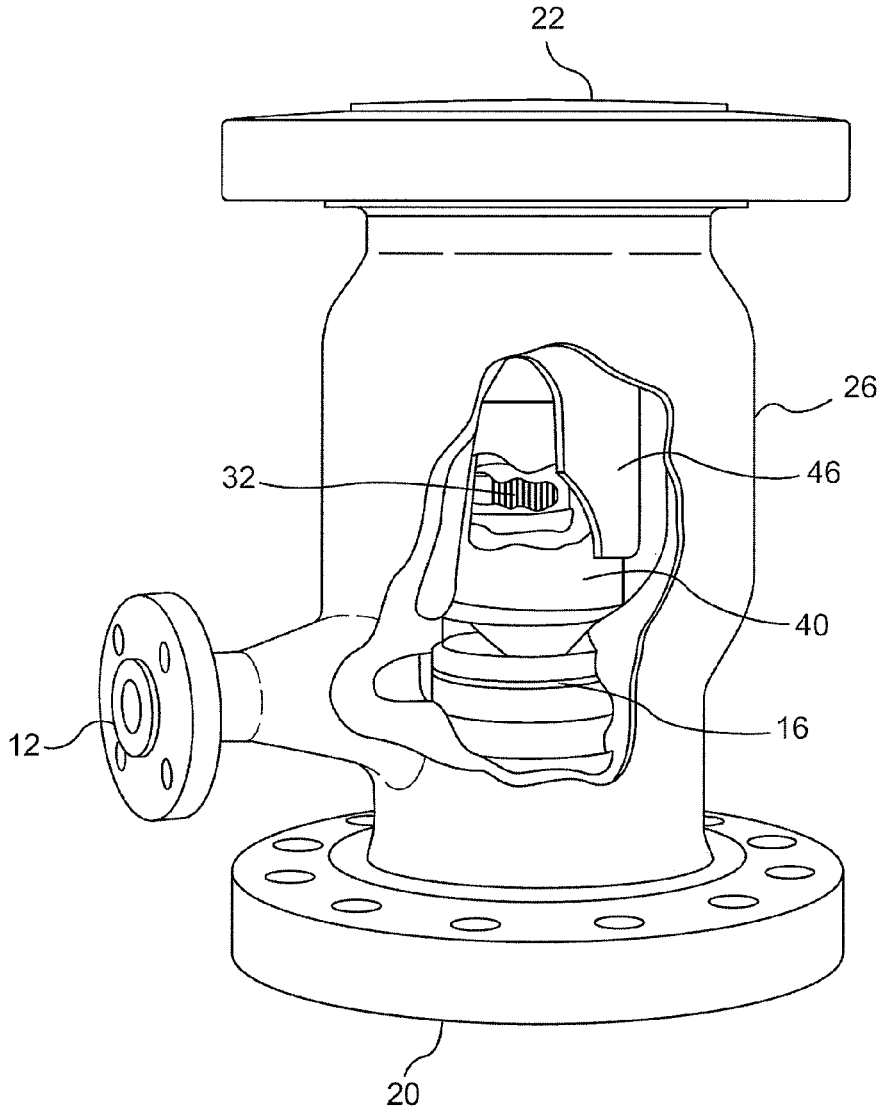
FIG. 5 illustrates a cutaway view of a desuperheater valve with flange connection.

When the desuperheater valve operation is closed, the plug assembly 40 meets up with the seat injection ring 16 covering the slot 21. As the superheated fluid enters the desuperheater valve and the pressure builds, the generally cylindrical valve plug assembly 40 lifts, permitting the cooling fluid to with the superheated fluid, and thus lowering the temperature of the superheated fluid. FIG. 5 illustrates a cutaway view of the desuperheater valve of the present invention showing parts placement.

Figure 7:
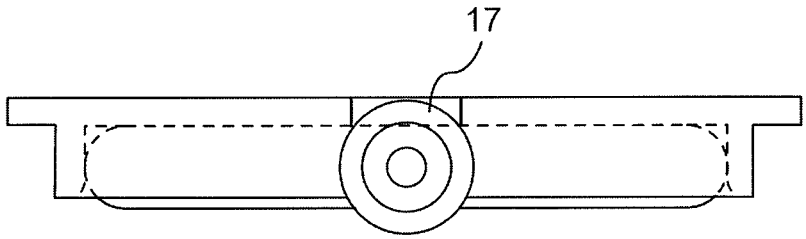
FIG. 7 is a slide view of the seat ring showing the cooling fluid inlet which is deployed inside the seat ring.
Figure 6:
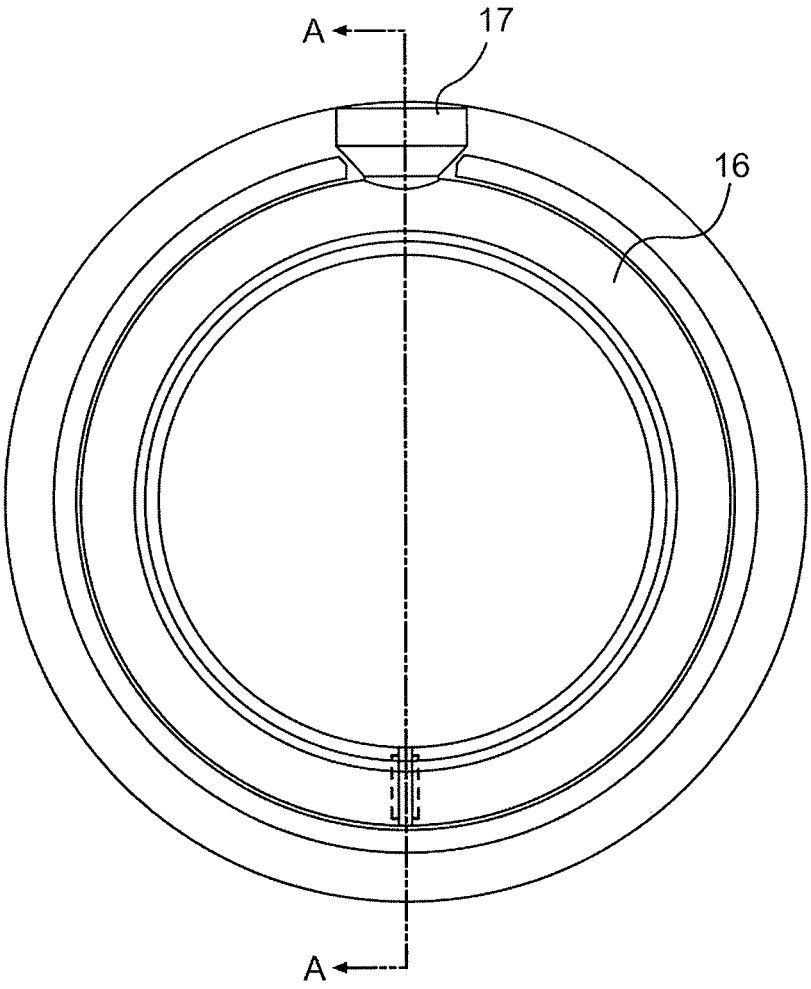
FIG. 6 is a plan view of the seat ring deployed in another embodiment of the present invention.
Figure 8:
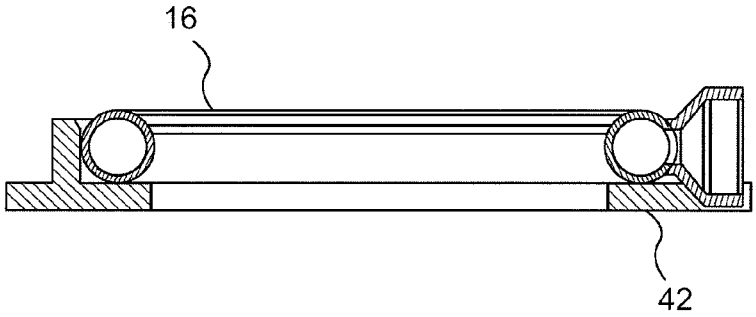
FIG. 8 is a side view orientation of the seat ring and its location in conjunction with seat ring support of the embodiment show in FIG. 6.

Now referring to FIGS. 6-8, the coolant nipple 17 is placed inside the seat injection ring 16. This configuration provides valve designers more flexibility when sizing and scaling desuperheater valves. FIG. 8 illustrates an inner inlet seat ring support 43 which would accommodate the coolant nipple 17 if it were to be placed inside the seat injection ring 16.

The desuperheater valve can be made out of various temperature and pressure tolerant materials. For example, the desuperheater valve can be made out of carbon steel, stainless steel and other types of low alloy steel.

The processes and devices in the above description and drawings illustrate examples of only some of the methods and devices that could be used and produced to achieve the objects, features, and advantages of embodiments described herein and embodiments of the present invention can be applied to indirect dry, direct dry and wet type heat exchangers. Thus, they are not to be seen as limited by the foregoing description of the embodiments, but only limited by the appended claims. Any claim or feature may be combined with any other claim or feature within the scope of the invention.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A desuperheating device for in-line operation in conjunction with superheated fluid piping upstream and downstream therefrom and of type comprising:

an upper housing section and a lower housing section joined with a middle housing chamber of enlarged diameter relative to the upstream and downstream piping to form a mixing chamber of enlarged diameter relative to the upstream and downstream piping, wherein said joined housing sections being adapted for connection to said upstream and downstream piping;

a desuperheater seat ring support fixed in said middle housing and supporting therewith an annular seat injection ring having a circumference with a slot and a annular seat injection ring being adapted for connection to a cooling fluid inlet piping to supply a cooling fluid to said annular seat injection ring, wherein said slot completely encircles and surrounds said circumference of said seat injection ring; and a valve plug slideably received in an axially disposed valve cage base structure to cooperate with said slot of said annular seat injection ring.

2. The desuperheating device according to claim 1 further includes an axially disposed valve cage base structure mounted on said desuperheater seat ring support.

3. The desuperheating device according to claim 2, wherein said annular seat injection ring is shaped like a torus.

4. The desuperheating device according to claim 3, wherein said annular seat injection ring is hollow.

5. The desuperheating device according to claim 4, wherein said annular seat injection ring is interrupted by a first seat ring end.

6. The desuperheating device according to claim 4, wherein said annular seat injection ring is interrupted by said first seat ring end and a second seat ring end.

7. The desuperheating device according to claim 2, wherein said cooling fluid inlet piping has a coolant nipple located immediately adjacent said annular seat injection ring.

8. The desuperheating device according to claim 2, wherein said cooling fluid inlet piping has a coolant nipple located inside said annular seat injection ring.

9. The desuperheating device according to claim 2, wherein said slot is circular.

10. The desuperheating device according to claim 2, wherein said annular seat injection ring is made out of carbon steel.

11. The desuperheating device according to claim 3, wherein said annular seat injection ring is made from stainless steel.

* * * * *